US008693932B2

(12) United States Patent
Okamoto

(10) Patent No.: US 8,693,932 B2
(45) Date of Patent: Apr. 8, 2014

(54) FIXING DEVICE AND IMAGE FORMING APPARATUS

(75) Inventor: Jun Okamoto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 68 days.

(21) Appl. No.: 13/357,135

(22) Filed: Jan. 24, 2012

(65) Prior Publication Data

US 2012/0195623 A1 Aug. 2, 2012

(30) Foreign Application Priority Data

Jan. 31, 2011 (JP) ..... 2011-017982

(51) Int. Cl.
*G03G 15/20* (2006.01)

(52) U.S. Cl.
CPC ..... *G03G 15/2075* (2013.01); *G03G 15/20* (2013.01)
USPC ..... 399/327; 399/328; 399/329

(58) Field of Classification Search
CPC ..... G03G 15/20
USPC ..... 399/326, 327–329
See application file for complete search history.

(56) References Cited

U.S. PATENT DOCUMENTS

| | | | | |
|---|---|---|---|---|
| 4,018,555 | A * | 4/1977 | Thettu | 399/327 |
| 5,168,314 | A * | 12/1992 | Gunji et al. | 399/327 |
| 5,300,996 | A | 4/1994 | Yokoyama et al. | |
| 5,648,842 | A | 7/1997 | Sekine et al. | |
| 5,678,153 | A * | 10/1997 | Okamoto et al. | 399/327 |
| 5,679,462 | A | 10/1997 | Soga et al. | |
| 5,873,017 | A | 2/1999 | Soga et al. | |
| RE36,124 | E | 3/1999 | Yokoyama et al. | |
| 5,913,092 | A | 6/1999 | Bisaiji et al. | |
| 6,067,435 | A | 5/2000 | Soga et al. | |
| 6,125,257 | A | 9/2000 | Sekine et al. | |
| 6,263,176 | B1 * | 7/2001 | An et al. | 399/101 |
| 6,771,925 | B2 * | 8/2004 | Satoh | 399/327 |
| 7,437,111 | B2 | 10/2008 | Yamada et al. | |
| 7,548,717 | B2 * | 6/2009 | Tateishi et al. | 399/326 |
| 7,610,005 | B2 * | 10/2009 | Ide | 399/327 |
| 7,702,271 | B2 | 4/2010 | Yamada et al. | |
| 8,023,850 | B2 | 9/2011 | Okamoto et al. | |
| 8,027,627 | B2 | 9/2011 | Okamoto et al. | |
| 2003/0002894 | A1 * | 1/2003 | Satoh | 399/324 |
| 2006/0291918 | A1 * | 12/2006 | Tohata | 399/327 |
| 2007/0122212 | A1 * | 5/2007 | Shinkawa et al. | 399/326 |
| 2008/0226363 | A1 * | 9/2008 | Tateishi et al. | 399/327 |
| 2009/0274477 | A1 | 11/2009 | Okamoto et al. | |
| 2009/0274495 | A1 | 11/2009 | Okamoto et al. | |

(Continued)

FOREIGN PATENT DOCUMENTS

| | | |
|---|---|---|
| JP | 2005-266746 | 9/2005 |
| JP | 2008-129279 | 6/2008 |

*Primary Examiner* — Clayton E Laballe
*Assistant Examiner* — Kevin Butler
(74) *Attorney, Agent, or Firm* — Oblon, Spivak, McClelland, Maier & Neustadt, L.L.P.

(57) ABSTRACT

A fixing device that fixes a toner image on a recording medium while the recording medium is conveyed by passing through a nip formed by a heating member and a pressing member including: a cleaning unit that is provided in at least any one of the heating member and the pressing member for removing toner adhered thereto. The cleaning unit is in contact with a member to be cleaned and a rotating cleaning member is in contact with the member to be cleaned in a downstream side of the cleaning unit in a rotation direction.

9 Claims, 3 Drawing Sheets

(56) References Cited

U.S. PATENT DOCUMENTS

2009/0274496 A1 11/2009 Okamoto et al.
2009/0274497 A1 11/2009 Okamoto et al.
2009/0304420 A1* 12/2009 Klymachyov et al. ..... 399/327
2011/0222923 A1* 9/2011 Watanabe ..... 399/326
2011/0229224 A1* 9/2011 Watanabe ..... 399/328

* cited by examiner

FIXING DEVICE AND IMAGE FORMING APPARATUS

CROSS-REFERENCE TO RELATED APPLICATION

The present application claims priority to and incorporates by reference the entire contents of Japanese Patent Application No. 2011-017982 filed in Japan on Jan. 31, 2011.

BACKGROUND OF THE INVENTION

1. Field of the Invention

The present invention relates to a fixing device that fixes a toner image onto a recording medium while conveying the recording medium by causing the recording medium to pass through a nip portion formed by a heating member and a pressing member and an image forming apparatus such as a copying machine, a printer, a facsimile, or a multifunction peripheral (MFP).

2. Description of the Related Art

In the image forming apparatus of an electrophotographic system described above, a fixing device is provided to fix a toner image onto the recording medium while the recording medium is conveyed by passing through a nip between the heating member and the pressing member. This type of fixing device has a configuration in which the pressing roller serving as a pressing member is brought into pressure contact with a fixing unit (a roller or a belt) having a heat source therein, a transfer sheet with an unfixed toner image thereon passes through a pressing portion between the roller or the belt and the pressing roller, and thus the toner is fixed onto the transfer sheet. The surface of the fixing member is coated with a silicone rubber or a fluorine coating material, for example, so as to prevent the toner from adhering to the surface thereof. However, depending on a condition such as a usage environment or a type of the transfer sheet, some amount of toner may leave the transfer sheet and adhere to the fixing roller, being called an offset phenomenon.

It is known that the offset toner remains on the fixing roller or the pressing roller that may be brought into contact with the fixing roller and may be reversely transferred onto the transfer sheet, thereby causing an image to be contaminated. In order to prevent such a problem from occurring, the fixing roller or the pressing roller may be in contact, as a cleaning means, with a swabbing roller or a take-up web that contains oil.

The minutely offset toner may move from the fixing roller or the pressing roller to the swabbing roller due to a difference in the mould releases, or may adhere to the surface of the web because the web is in contact with the roller by terminating the rotation of the roller. The offset toner adhered to the web is removed by being taken up and thus a new surface thereof is always brought into contact with the fixing roller or the pressing roller.

In general, the web has a function, as disclosed in Japanese Patent Application Laid-open No. 2008-129279, such that cleaning performance can be improved for large impregnation of oil by adsorbing the toner and the cleaning performance may be degraded for small impregnation of oil due to the improvement of the oil swabbing performance. In Japanese Patent Application Laid-open No. 2008-129279, the web has two contact portions where the web has different impregnation of oil so as to maintain the cleaning performance and the oil swabbing performance. However, there is concern that abnormality such as an image stripe may occur if the swabbing amount of oil supplied from the web is increased.

Conversely, if the impregnation amount of oil in the web is simply reduced, absorption (collection) of the offset toner to the web becomes insufficient. Accordingly, part of the offset toner evades from the web, causing reverse transfer of the offset toner to the transfer sheet, or the part of the offset toner passes through the nip portion again and is stopped by the web again in a state with a reduced viscosity, resulting in the offset toner being adhered to the portion. The adhered portion may cause damage on the fixing roller or the pressing roller by being in contact therewith.

In addition, the toner remaining on the web is not in a state of being sufficiently heated immediately after the activation from the cooled state or the returning from the off mode. Furthermore, if the toner has not yet been heated enough so as to enter a viscous state, the toner cannot be absorbed and fixed to the surface of the web, so that the cleaning performance is insufficient. Even in a case where a large amount of a releasing agent is contained, the toner is in a floating state on the fixing roller or the pressing roller due to the oil supplied from the web. When a paper sheet passes in this state, the offset toner floating on the fixing roller or the pressing roller may move to the transfer sheet to cause toner contamination. This phenomenon occurs significantly in an apparatus that has a short activation period.

Recently, the fixing device is configured such that a heat source (heater) is disconnected from a power supply in a standby mode in order to reduce a value of the typical electricity consumption (TEC) or to save energy. Furthermore, the heat source is supplied with power when the image formation starts, and the fixing roller and the like are heated up to the temperature sufficiently high for fixing the toner. For this reason, the fixing roller or the heating roller with which a belt is suspended is formed to be thinner than 1 mm or less, so that thermal responsiveness is improved and the activation time taken for fixing the toner is shortened. Therefore, usability by a user and energy saving are achieved. With this configuration, because the thermal capacity of the fixing roller or the heating roller is small, the fixing roller or the heating roller is easily affected by the thermal migration to the transfer sheet or to a contact member of the fixing roller or the fixing belt, by the flow of air, or by the like so that the temperature distribution may vary largely depending on a position of each element.

If the temperature distribution in the fixing roller is not uniform, the offset may occur due to the disagreement in the fixing conditions or the lifetime of the roller may be shortened due to the thermal deterioration. A particularly serious problem is a reverse transfer in which the toner lump deposited on the cleaning roller or the web melts again and is transferred onto the transfer sheet. The problem is serious when a size of a sheet is smaller than the maximum size of the sheet that can be passed (because a sheet with a small size is in contact with the fixing roller in a small area, from which heat is robbed by the sheet, resulting in a decrease in the temperature only in the sheet passing portion without causing a decrease in the temperature in a sheet non-passing portion, such as the fixing roller or the fixing belt. Therefore, because a temperature detecting unit that is provided to a corresponding portion instructs a heater to turn on, the temperature of the sheet non-passing portion increases unnecessarily and thus the toner adhered to the cleaning roller corresponding to the portion also melts, causing the toner to be reversely transferred).

In other words, when an amount of toner that adheres to the cleaning roller or the web is increased and heat is applied to the adhered toner due to continuous passing of the sheets, the adhered toner melts and the viscosity thereof is lowered, the offset toner is decoupled from the adhered toner on the surface of the cleaning roller, and the collection performance (adhesiveness≈cleaning performance) may be degraded. As a result, the offset toner adhered to the cleaning roller or the web is reversely transferred and the so-called melting out of the toner may occur. The offset toner occurs more easily as the image area becomes larger, and the reverse transfer may be caused by a rise in the temperature of the cleaning roller or the web due to the continuous passing of the sheets.

As a method for preventing the melting out, the cleaning roller or the web may be provided on the pressing roller side where heat is not easily increased. Furthermore, in Japanese Patent Application Laid-open No. 2005-266746, a cross-linking agent is coated on the cleaning roller to prevent the melting out from occurring. In this method, the cross-linking agent is applied onto the surface of the cleaning roller in advance so as to cause the cross-linking agent to react with the toner (cross-linking reaction), thereby increasing the viscosity of the toner and preventing the melting out from occurring. The cross-linking agent is dispersed in the adhered toner to perform the cross-linking reaction. Therefore, the toner that is collected to the cleaning roller is in a highly viscous state, and this effectively prevents the melting out from occurring. However, the method is disadvantageous in terms of the toner contamination on the transfer sheet immediately after the activation.

In a case where the cleaning roller or the web is made to be in contact with the pressing roller, the oil impregnated in the cleaning roller or the web is supplied to the fixing roller only in an inter-sheet interval during the passage of the sheets. Therefore, an image stripe (offset) is easily generated due to oil-caused gloss on the image.

For this reason, it is desirable to reduce the impregnation amount of oil to the web so as to suppress the occurrence of the image stripe caused by the oil. At the same time, it is required to provide an apparatus that maintains the cleaning performance by suppressing the occurrence of an abnormal image caused by the offset toner.

Therefore, there is a need for solving the above described problem and for providing an image fixing apparatus and an image forming apparatus that can reduce a problem that a recording medium may be contaminated by evading a cleaning unit of the offset toner.

SUMMARY OF THE INVENTION

It is an object of the present invention to at least partially solve the problems in the conventional technology.

A fixing device that fixes a toner image on a recording medium while the recording medium is conveyed by passing through a nip formed by a heating member and a pressing member includes: a cleaning unit that is provided in at least any one of the heating member and the pressing member for removing toner adhered thereto. The cleaning unit is in contact with a member to be cleaned and a rotating cleaning member is in contact with the member to be cleaned in a downstream side of the cleaning unit in a rotation direction.

An image forming apparatus includes: a fixing device that fixes a toner image on a recording medium while the recording medium is conveyed by passing through a nip formed by a heating member and a pressing member and that includes a cleaning unit that is provided in at least any one of the heating member and the pressing member for removing toner adhered thereto. The cleaning unit is in contact with a member to be cleaned and a rotating cleaning member is in contact with the member to be cleaned in a downstream side of the cleaning unit in a rotation direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

Hereinafter, an embodiment of the invention will be described with reference to the accompanying drawings.

Figure 1:
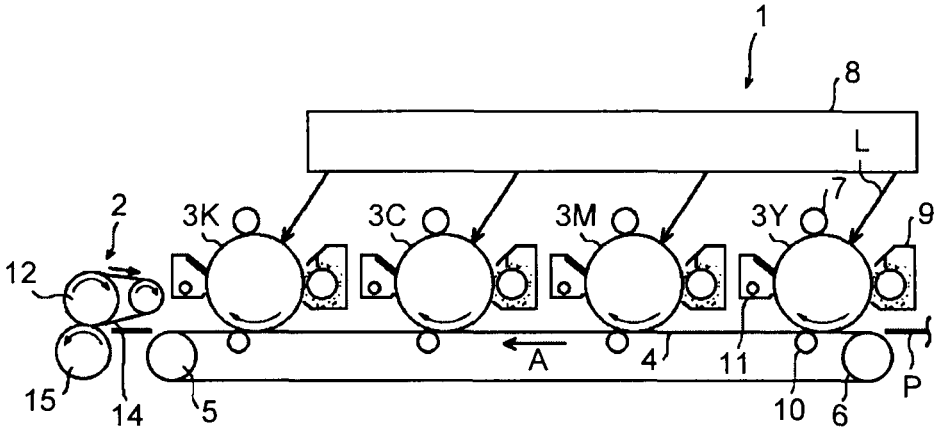
FIG. 1 is a diagram schematically illustrating an entire configuration of an image forming apparatus according to the embodiment.

FIG. 1 is a schematic diagram illustrating a part of a color printer as an example of an image forming apparatus. The image forming apparatus illustrated in the drawing includes an image forming device 1 that forms a toner image on a recording medium and a fixing device 2 that fixes the toner image on the recording medium. First, the image forming device 1 will be schematically described.

The image forming device 1 illustrated in FIG. 1 includes a first to fourth image carriers 3Y, 3M, 3C, and 3K that are configured as drum-shaped photosensitive elements. A yellow toner image, a magenta toner image, a cyan toner image, and a black toner image are formed on the respective image carriers. A transfer belt 4 is provided so as to face the first to fourth image carriers 3Y to 3K. The transfer belt 4 is wound around a driving roller 5 and a driven roller 6 and is driven to move in the direction indicated by an arrow A.

The configurations of the first to fourth image carriers 3Y, 3M, 3C, and 3K and the operations of forming toner images thereof are the same, and therefore, only the configuration of forming a toner image on the first image carrier 3Y will be described. When the image carrier 3Y is driven to rotate in the clockwise direction in FIG. 1, a surface of the image carrier 3Y is uniformly charged with a predetermined polarity by a charging roller 7. Next, a laser beam L that has been optically modulated and emitted from a laser writing unit 8 is irradiated to the charged surface. Thus, an electrostatic latent image is formed on the image carrier 3Y, and a developing unit 9 makes the electrostatic latent image visible as a yellow toner image.

On the other hand, a recording medium P formed by, for example, a transfer sheet, a resin sheet, or a resin film is fed from a paper feeding unit (not illustrated) into a gap between the image carrier 3Y and the transfer belt 4. Then, the recording medium P is conveyed by being carried on the transfer belt 4. A transfer roller 10 is provided to a position substantially facing the image carrier 3Y with the transfer belt 4 interposed therebetween. A voltage with an opposite polarity to the charging polarity of toner on the image carrier 3Y is applied to the transfer roller 10, thereby the yellow toner image on the image carrier 3Y is transferred onto the recording medium P. Transfer residual toner that has not been transferred onto the recording medium P and remains on the image carrier 3Y is removed by a cleaning device 11.

Similarly, a magenta toner image, a cyan toner image, and a black toner image are formed on the second to fourth image carriers 3M, 3C, and 3K, respectively. These toner images are sequentially transferred onto the recording medium P onto which the yellow toner image has been transferred in a superimposed manner.

The recording medium P, on which a four-color toner image has been formed as described above, passes through the fixing device 2, where the toner image is fixed on the recording medium P. The recording medium that has passed through the fixing device 2 is discharged onto a discharge tray (not illustrated).

Figure 2:
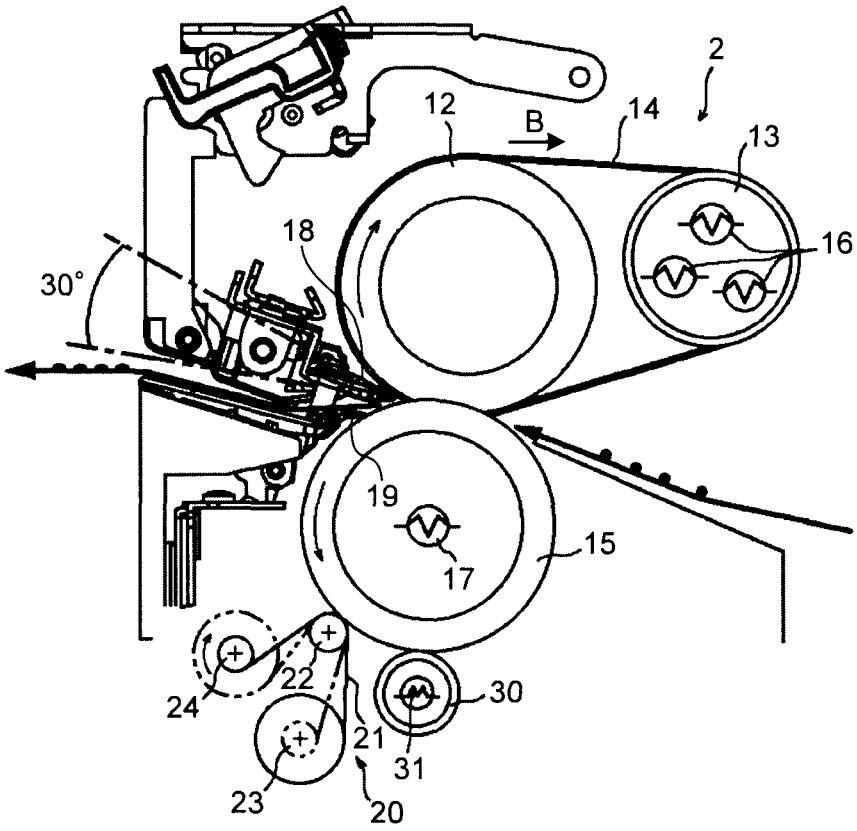
FIG. 2 is a side view illustrating a fixing device of the image forming apparatus.

FIG. 2 is a front view illustrating the fixing device 2 when the image forming apparatus body is viewed from the front side. The fixing device 2 illustrated in the drawing includes a fixing roller 12 that is rotatably supported on a main frame (not illustrated) of the fixing device 2 and a cylindrically-shaped heating roller 13 that is rotatably supported on the main frame. The rollers 12 and 13 are wound with a fixing belt 14 formed by an endless belt. In addition, a cylindrical pressing roller 15 is provided to face the fixing roller 12 through the fixing belt 14. Heaters 16 and 17 are provided inside the pressing roller 15 and the heating roller 13, respectively. Furthermore, separating claws 18 and 19 are provided in the fixing belt 14 and the pressing roller 15, respectively.

The pressing roller 15 is in pressure contact with the fixing roller 12 with the fixing belt 14 interposed therebetween, as described later, and the pressing roller 15 is driven to rotate in the counterclockwise direction in FIG. 2. With the configuration, the fixing belt 14 is driven to rotate in the direction indicated by an arrow B, and along with this rotation, the fixing roller 12 and the heating roller 13 rotate in the clockwise direction in FIG. 2. At that time, the heating roller 13 is heated by the heater 16 formed by a halogen lamp, for example, and the pressing roller 15 is heated by the heater 17.

Here, specific examples of the respective elements included in the fixing device 2 will be described. The fixing belt 14 is an endless belt in a multilayered structure in which an elastic layer and a releasing layer are sequentially laminated on a base layer made of a polyimide resin with a film thickness of 90 μm. The elastic layer of the fixing belt 14 has a film thickness of about 200 μm and is formed of an elastic material such as a silicone rubber, a fluorine-contained rubber, or a foaming silicone rubber, or the like. The releasing layer of the fixing belt 14 has a film thickness of about 20 μm, that is formed of a tetrafluoroethylene-perfluoroalkyl vinyl ether copolymer (PFA), a polyimide resin, a polyetherimide resin, a polyether sulfone (PES), or the like. The releasing layer is provided at a surface layer of the fixing belt 14, thereby securing release characteristics (peel property) with respect to the toner T (toner image).

As described above, the fixing device 2 according to the embodiment is provided with a cleaning unit 20 that serves to collect offset toner adhered to the pressing roller 15 as illustrated in FIG. 2. The cleaning unit 20 illustrated in the drawing is a take-up type web unit that is also used for oil swabbing. The cleaning unit 20 includes a push roller 22 that pushes a web 21 containing oil on the pressing roller 15, a feeding shaft 23 around which the web is wound, and a take-up shaft 24 that takes up the web 21 in a suspended state.

However, in a known fixing device that employs the cleaning unit 20, when a supply amount of toner to the web 21 increases due to continuous passing of the sheets, the toner remains on the pressing roller 15 by being stopped by the web 21. In this case, when the fixing device is cooled down due to power-off or the like and then activated again, the residual toner causes a problem such that the toner evades from the web 21 to be reversely transferred onto the recording medium.

Figure 6:
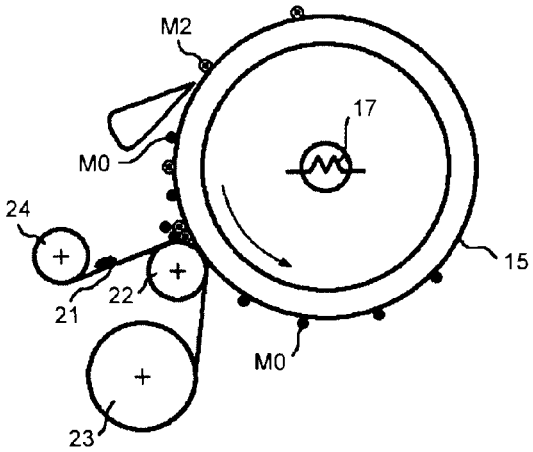
FIG. 6 is a diagram illustrating a process that is performed on the pressing roller of the fixing device to an offset toner according to the related art.

FIG. 6 illustrates a fixing device that includes a web unit in the cleaning unit 20 according to the related art.

In FIG. 6, in a case where a machine starts to be activated at a room temperature in the morning, the offset toner that remains by being stopped by the web 21 is in a cooled state at a temperature of M0. Offset toner M0 is not collected by the web 21 but may freely move between members being in contact with the pressing roller 15. Therefore, the offset toner M0 at a low temperature evades from the web 21 to contaminate the fixing belt 14 or the back surface of the recording medium P. Furthermore, if the toner that evades from the web 21 returns to the web 21, the toner is warmed up by the pressing roller 15 and heated at a fixing nip portion to be in an M2 state in which the toner has low viscosity at a high temperature. Although the offset toner M2 at a high temperature rarely evade from the web 21, the offset toner may be stopped by the web 21 and then be fixed thereon. The adhered toner is not sufficiently collected through the take-up operation of the web and may be released outside or may damage the surface of the pressing roller 15. For this reason, it is desired that a problem caused by the offset toner M0 evading from the web 21 be solved.

Figure 3:
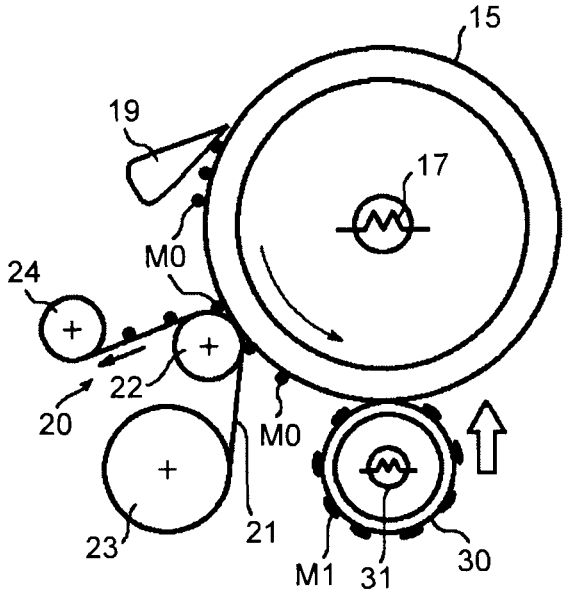
FIG. 3 is a diagram illustrating a process that is performed on a pressing roller to an offset toner immediately after a startup.

FIG. 3 is an explanatory diagram illustrating the fixing device 2 immediately after the activation in a cooled state.

In FIG. 3, when the fixing device 2 is in the cooled state, if there is the offset toner remaining by being stopped by the web 21 is present, the toner is in the M0 state. Because the toner M0 is likely not to be collected by the web 21 but may freely move among members that are in contact with the pressing roller 15, a part of the toner M0 may evade from the web 21, as described above. In the embodiment, as illustrated in FIGS. 2 and 3, a cleaning roller 30 serving as a rotating cleaning member is provided to be in contact with the pressing roller 15 at a position between the downstream side of the web cleaning unit 20 in the rotation direction of the pressing roller 15 and the fixing nip portion N. Therefore, the toner M0 that has evaded from the web 21 is warmed up by the pressing roller 15 so that the temperature is changed from M0 to M1. If the toner enters the state of M1, adhesion occurs in the toner, so that the toner can be collected by the cleaning roller 30 without the occurrence of an evasion. Therefore, the problem such as the contamination of the recording medium caused by the offset toner may be resolved. However, because the distance from the web 21 to the cleaning roller 30 is short, there is concern that the toner M0 that has evaded from the web 21 does not reach the state M1 but may evade even from the cleaning roller 30.

The cleaning roller 30 according to the embodiment is configured to be heated by a heating unit 31. Therefore, by heating the cleaning roller 30 at the time of the activation, even when the toner that has reached the cleaning roller 30 is in the M0 state, the toner is warmed up by the heating unit 31 to enter the M1 state and is certainly collected by the cleaning roller 30. In the meantime, although the heating unit 31 illustrated in the drawings is configured to include a built-in heater, the heater of the heating unit 31 is not limited to a built-in type, but a heater using radiation heat or an induction heating coil may be employed.

When some length of time elapses after the machine has been activated, the pressing roller 15 is also sufficiently warmed up by the heater 17 and the offset toner that has been stopped by the web 21 is brought into a state of M2 at a higher temperature than that in the M1 state. When the offset toner enters the high-temperature M2 state, there is no evasion or floating of the toner. Therefore, the toner does not evade from the web 21 but is collected by the web 21, so that the cleaning roller 30 does not need to be used any more.

Figure 4:
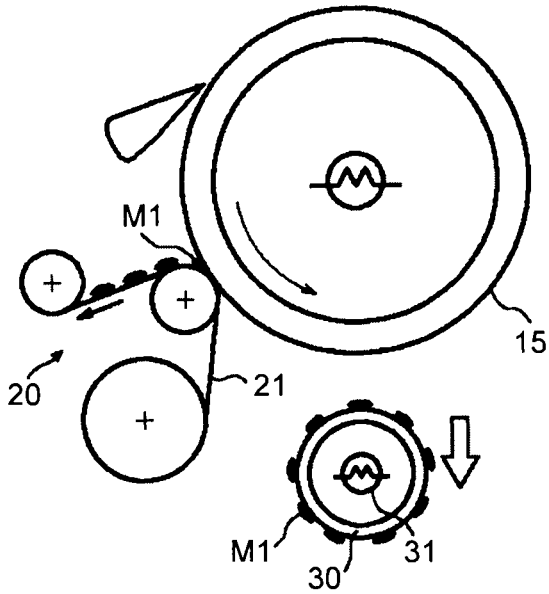
FIG. 4 is an explanatory diagram illustrating the process that is performed on the pressing roller to the offset toner in a heated state.

Accordingly, a contact/separation unit (not illustrated) is provided to bring the cleaning roller 30 into contact with the pressing roller 15 or to separate the cleaning roller 30 from the pressing roller 15. When the offset toner enters the high-temperature M2 state, as illustrated in FIG. 4, the cleaning roller 30 is separated from the pressing roller 15 so as to achieve a long lifetime for each member.

In addition, the surface of the cleaning roller 30 is preferably coated with a cross-linking agent. The offset toner may have a cross-linking reaction with the cross-linking agent coated on the surface of the cleaning roller to have high viscosity; thereby melting out of the offset toner may be prevented.

Figure 5:
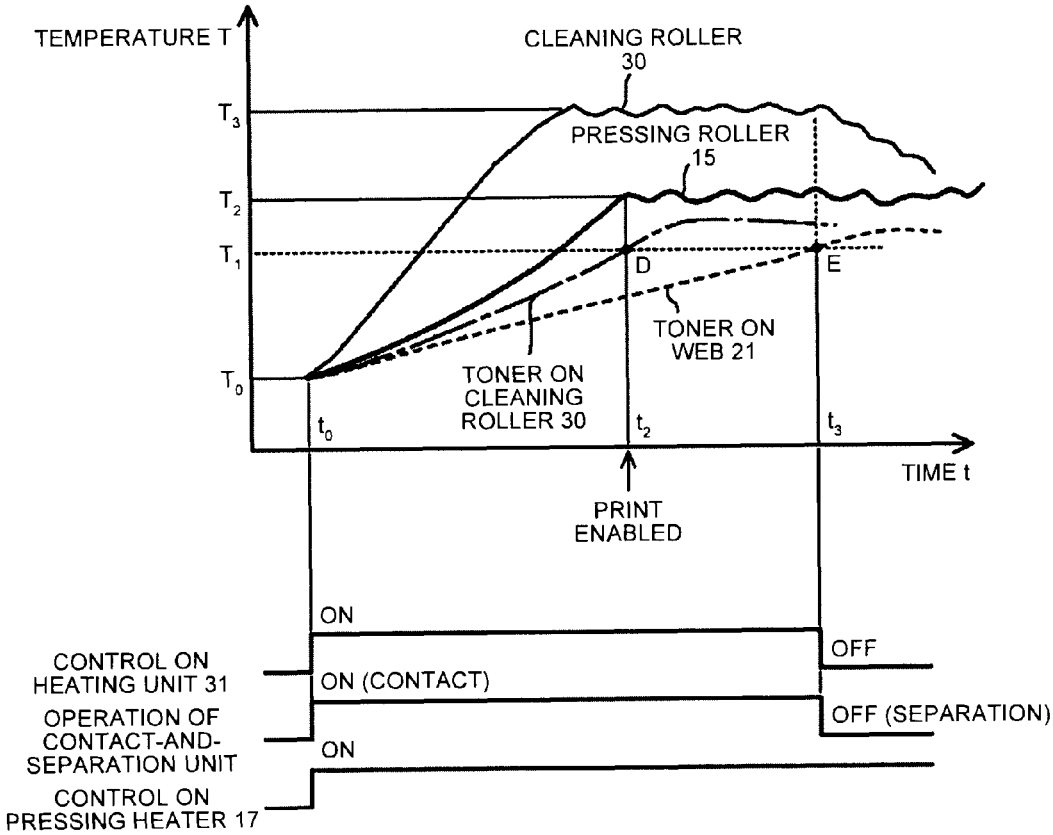
FIG. 5 is a graph illustrating a relation between time and temperature of a cleaning roller, the pressing roller, and toner after the activation.

FIG. 5 illustrates states of the pressing roller 15, the cleaning roller 30, and the toner adhered thereto after the activation from the cooled state by a combination of a graph that shows timing of each heater and a motor of the contact/separation unit corresponding to the states and a timing chart of the respective units.

In FIG. 5, the symbol $t_0$ on the horizontal axis in the graph denotes time when the activation is performed at a room temperature, the symbol $t_2$ denotes time when the activation is completed and a printing is ready, the symbol $t_3$ denotes time when the temperature of the offset toner reaches M2, and the vertical axis represents a temperature. Furthermore, the graph represents the changes in temperature of the pressing roller 15, the temperature of the offset toner adhered to the web 21 of the cleaning roller 30, and the temperature of the offset toner adhered to the cleaning roller 30.

In addition, in the timing chart illustrated in the lower portion of FIG. 5, the operation timing of the heating unit 31 of the cleaning roller 30 and the contact/separation unit (not illustrated) of the cleaning roller 30, and the control timing of the pressing heater 17 are illustrated in correspondence with the time axis of the upper graph. As can be seen clearly from this timing chart, at the time of the activation, the cleaning roller 30 is in contact with the pressing roller 15 and the heating unit 31 is turned ON. Furthermore, the heater 17 of the pressing roller 15 is also turned ON. Then, at the time $t_3$ when the temperature of the offset toner reaches M2, while the heater 17 remains in the turned-ON state, the pressing roller 15 is separated from the cleaning roller 30 and the heating unit 31 is turned off.

As can be seen clearly from FIG. 5, the temperature of the offset toner starts to increase from the initial temperature $T_0$. In a case where the offset toner is collected onto the cleaning roller 30, the temperature thereof increases up to the intersection D at which the curve intersects with the line of the temperature $T_1$. At the time $t_2$ where a printing operation can be performed, the offset toner is heated to reach the temperature $T_1$ so as to be fixed on the cleaning roller 30 due to the viscosity of the toner. Furthermore, the pressing roller 15 starts to be driven to rotate when the temperature of the toner reaches a temperature that is lower than $T_2$ and at which the toner starts to melt.

In contrast, in the related art where the function of the cleaning roller 30 is not provided, the offset toner remains on the web 21 and the pressing roller 15, and the temperature of the offset toner follows the curve that starts at the temperature $T_0$ and passes the intersection E at the temperature $T_1$. Accordingly, the time $t_2$ at which the printing operation can be performed becomes earlier than the time $t_3$ at which the temperature of the toner reaches the temperature $T_1$, and therefore, an image may be contaminated by a floating toner during the time period between $t_2$ and $t_3$.

In the embodiment, the cleaning roller 30 heats the pressing roller 15 by being in contact therewith until the time $t_3$ arrives. Therefore, even if the floating toner evades from the cleaning unit 20, the toner is collected (adhered), so that a cleaning function can be achieved.

The embodiment has been described above but is not limited thereto, and various modifications can be made.

In the above embodiment, the cleaning unit 20 and the cleaning roller 30 have been provided on the side of the pressing roller. However, these members may be provided on the fixing side. In this case, in order to perform cleaning at the fixing side, the surface of the fixing member may be damaged by a cleaning member, so that the image quality is degraded. For this reason, in the embodiment, the cleaning unit and the cleaning roller have been described to be provided on the pressing side.

In addition, in the above embodiment, the cleaning unit 20 has been configured to employ the web cleaning system. However, the cleaning unit 20 may be configured to employ the cleaning roller or felt including oil swabbing.

Furthermore, the fixing device according to the embodiment can be applied to various types of devices, for example, a roller fixing device and a device using a pressing belt as long as the fixing device is a heat fixing device in which a fixing nip portion is formed.

According to the embodiment, a rotating cleaning member is provided on the downstream side of a cleaning unit in the rotation direction of a member to be cleaned. Therefore, the problem of the contamination of a recording medium due to the offset toner evading the cleaning unit may be reduced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device that fixes a toner image on a recording medium while the recording medium is conveyed by passing through a nip formed by a heating member and a pressing member, the fixing device comprising a cleaning unit configured to remove toner adhering to at least one of the heating member and the pressing member, the cleaning unit comprising:

a first cleaning unit configured to be in contact with a rotating member to be cleaned; and a second cleaning unit configured to contact with and separate from the rotating member to be cleaned at a downstream of the first cleaning unit in a rotation direction of the rotating member to be cleaned.

2. The fixing device according to claim 1, wherein the first cleaning unit is a take-up web.

3. The fixing device according to claim 1, wherein the second cleaning unit includes a rotating roller member.

4. The fixing device according to claim 3, wherein a cross-linking agent that reacts with toner is coated on a surface of the rotating roller member.

5. The fixing device according to claim 1, further comprising a contacting/separating unit configured to contact with and separate from the member to be cleaned.

6. The fixing device according to claim 1, wherein the second cleaning member is separated from the rotating member to be cleaned when temperature of the rotating member to be cleaned becomes one of being equal to and being higher than a predetermined temperature.

7. The fixing device according to claim 1, wherein the rotating member to be cleaned is the pressing member.

8. An image forming apparatus comprising a fixing device that fixes a toner image on a recording medium while the recording medium is conveyed by passing through a nip formed by a heating member and a pressing member, the fixing device comprising a cleaning unit configured to remove toner adhering to at least one of the heating member and the pressing member, the cleaning unit comprising:

a first cleaning unit configured to be in contact with a rotating member to be cleaned; and a second cleaning unit configured to contact with and separate from the rotating member to be cleaned at a downstream of the first cleaning unit in a rotation direction of the rotating member to be cleaned.

9. The fixing device according to claim 3, wherein the rotating roller member is heated by a heating unit.

* * * * *